US011215087B2

(12) United States Patent
Feng et al.

(10) Patent No.: US 11,215,087 B2
(45) Date of Patent: Jan. 4, 2022

(54) ORGANIC RANKINE CYCLE SYSTEM WITH SUPERCRITICAL DOUBLE-EXPANSION AND TWO-STAGE HEAT RECOVERY

(71) Applicant: JIANGSU UNIVERSITY, Zhenjiang (CN)

(72) Inventors: Yongqiang Feng, Zhenjiang (CN); Qian Wang, Zhenjiang (CN); Zhixia He, Zhenjiang (CN); Xin Wang, Zhenjiang (CN); Shuang Wang, Zhenjiang (CN); Jian Zhang, Zhenjiang (CN); Guofeng Liang, Zhenjiang (CN)

(73) Assignee: JIANGSU UNIVERSITY, Jiangsu (CN)

( * ) Notice: Subject to any disclaimer, the term of this patent is extended or adjusted under 35 U.S.C. 154(b) by 0 days.

(21) Appl. No.: 16/765,684

(22) PCT Filed: Jul. 5, 2019

(86) PCT No.: PCT/CN2019/094771
§ 371 (c)(1),
(2) Date: May 20, 2020

(87) PCT Pub. No.: WO2020/147270
PCT Pub. Date: Jul. 23, 2020

(65) Prior Publication Data

US 2021/0207499 A1 Jul. 8, 2021

(30) Foreign Application Priority Data

Jan. 17, 2019 (CN) ..... 201910044247.6

(51) Int. Cl.
*F01K 25/10* (2006.01)
*F01K 23/04* (2006.01)
*F01K 23/10* (2006.01)

(52) U.S. Cl.
CPC ..... *F01K 25/10* (2013.01); *F01K 23/04* (2013.01); *F01K 23/10* (2013.01)

(58) Field of Classification Search
CPC ..... F01K 25/10; F01K 23/10; F01K 23/04
USPC ..... 60/655, 651, 671
See application file for complete search history.

(56) References Cited

U.S. PATENT DOCUMENTS 7,096,665 B2 * 8/2006 Stinger ..... F01K 25/08 60/651
8,613,195 B2 * 12/2013 Held ..... F01K 3/185 60/660
2012/0291433 A1 * 11/2012 Meng ..... F01K 25/08 60/641.15

(Continued)

FOREIGN PATENT DOCUMENTS

CN 101408115 A 4/2009
CN 108425713 A 8/2018

(Continued)

*Primary Examiner* — Hoang M Nguyen
(74) *Attorney, Agent, or Firm* — Heslin Rothenberg Farley & Mesiti, P.C.

(57) ABSTRACT

The present invention discloses an Organic Rankine cycle system with supercritical double-expansion two-stage heat recovery, comprising a first-stage evaporation cycle system, a second-stage evaporation cycle system and a mixing system. The present invention has lower heat loss in the heat exchange process, better heat exchange effect and improved utilization efficiency of waste heat.

9 Claims, 1 Drawing Sheet

(56) References Cited

U.S. PATENT DOCUMENTS

| | | | | |
|---|---|---|---|---|
| 2013/0174552 | A1* | 7/2013 | Mahmoud | F01K 23/02 60/671 |
| 2015/0251924 | A1 | 9/2015 | Li et al. | |
| 2019/0048757 | A1* | 2/2019 | Noureldin | F01K 25/10 |

FOREIGN PATENT DOCUMENTS

| | | | |
|---|---|---|---|
| CN | 108827008 | A | 11/2018 |
| CN | 208347847 | U | 1/2019 |
| CN | 109812309 | A | 5/2019 |

* cited by examiner

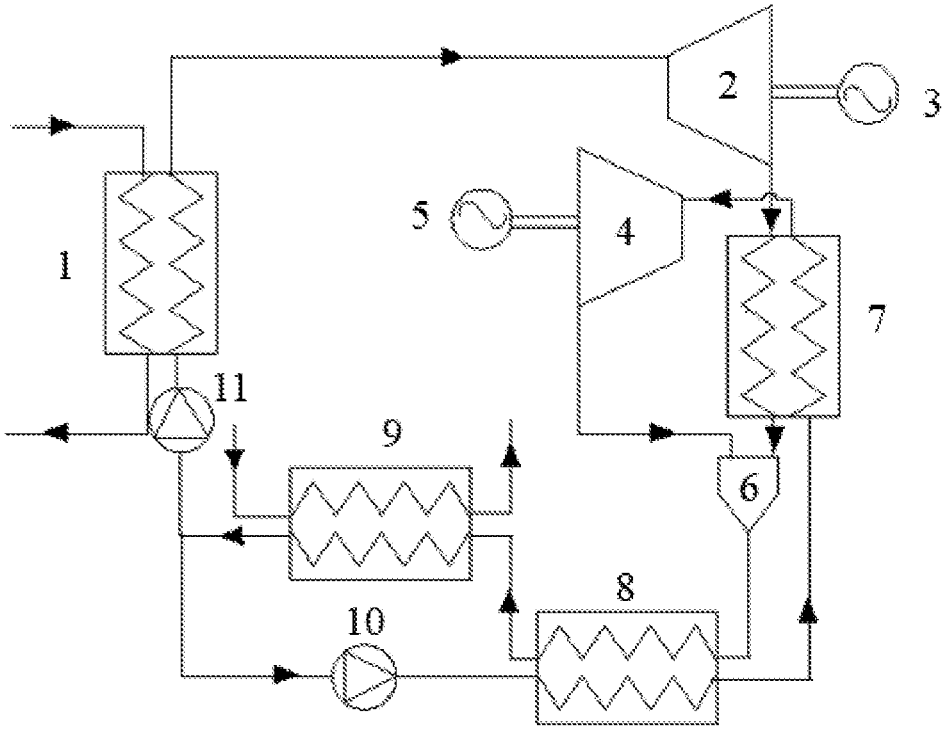
1
2
3
4
5
6
7
8
9
10
11

ORGANIC RANKINE CYCLE SYSTEM WITH SUPERCRITICAL DOUBLE-EXPANSION AND TWO-STAGE HEAT RECOVERY

This application is a U.S. National Phase filing under 35 U.S.C. § 371 of International Application PCT/CN2019/094771, filed Jul. 5, 2019. PCT/CN2019/094771 claims priority from Chinese Patent Application Number 201910044247.6, filed Jan. 17, 2019. The entire contents of each of these applications are hereby expressly incorporated herein by reference.

TECHNICAL FIELD

The present invention belongs to the technical field of Organic Rankine cycle systems for recovering low-grade heat, in particular to an Organic Rankine cycle system with supercritical double-expansion and two-stage heat recovery.

BACKGROUND ART

Presently, with the challenges of highly increasing demand for energy and increasingly serious environmental pollution, it is urgent to change the energy structure, save traditional energy resources and optimize the way of energy utilization; besides, fluid-grade and low-grade energy resources are especially rich, such as low-temperature and fluid-temperature waste heat energy, solar energy and geothermal energy, etc. As a fluid-temperature and low temperature waste heat recovery technique that is theoretically mature, Organic Rankine cycle has many advantages, such as simple structure, high efficiency and environmental friendliness, etc. Therefore, it is of great significance to utilize Organic Rankine cycle to efficiently recover fluid-grade and low-grade waste heat, in order to improve energy utilization efficiency issues and mitigate environmental.

However, at present, the thermal efficiency and power generation efficiency of Organic Rankine cycle system are relatively low and the development of the systems has reached a bottleneck period, which urges us to improve the structural design of the systems. A cascaded Organic Rankine cycle system and a distributed power generation system for multi-stage waste heat utilization have been developed in prior art. Although these systems have achieved the cascaded utilization of energy while improving efficiency, actually their thermal efficiency and power generation efficiency are still not high, and the energy loss is still severe.

CONTENTS OF THE INVENTION

With respect to the existing problems in the prior art, the present invention provides an Organic Rankine cycle system with supercritical double-expansion and two-stage heat recovery, for the purpose of providing an Organic Rankine cycle system that has lower exergy destruction in the heat exchange process, better heat exchange effect and improved utilization efficiency of waste heat.

The technical scheme employed by the present invention is as follows: An Organic Rankine cycle system with supercritical double-expansion and two-stage heat recovery comprises a first-stage evaporation cycle system, a second-stage evaporation cycle system and a mixing system, wherein the first-stage evaporation cycle system pressurizes working fluid to a supercritical pressure by means of a first working pump (working pump A), then the cycle working fluid is heated to a supercritical temperature by means of a first evaporator (evaporator A), and then inputs to a first expander (expander A) and then obtains electric energy; the second-stage evaporation cycle system feeds the cycle working fluid to a regenerator and a second evaporator (evaporator B) sequentially, and then feeds the cycle working fluid to a second expander (expander B) and then obtains electric energy; the outputs of the expander A and the expander B are connected to the mixing system, which cools down the cycle working fluid and then sends the cycle working fluid to the next cycle. The cycle working fluid can be pure working fluids of R115, R125, R143a or R218, or mixed working fluids of R404a or R507a.

Further, the first-stage evaporation cycle system comprises the working pump A, the outlet of the working pump A is connected to the inlet of the evaporator A, the outlet of the evaporator A is connected to the expander A, the expander A is connected to a first generator (generator A) the outlet of the expander A is connected to the inlet of the evaporator B, and the outlet of the evaporator B is connected to the inlet of a steam mixer.

Further, the second-stage evaporation cycle system comprises the working pump B, the outlet of the working pump B is connected to the inlet of the regenerator, the outlet of the regenerator is connected to the inlet of the evaporator B, the outlet of the evaporator B is connected to the expander B, the expander B is connected to a second generator (generator B), and the outlet of the expander B is connected to the inlet of a steam mixer.

Further, the mixing system comprises a steam mixer, the outlet of the steam mixer is connected to the inlet of the regenerator, the outlet of the regenerator is connected to the inlet of a condenser, and the outlet of the condenser is respectively connected to the working pump A and the working pump B.

Further, the working pump A pressurizes the cycle working fluid to the supercritical pressure.

Further, the evaporator A heats the cycle working fluid to a supercritical temperature.

The present invention has the following beneficial effects:

The first-stage evaporation of the system utilizes a supercritical state to recover the waste heat resource, and the exhaust steam from the outlet of expander is used for the second-stage evaporation to recover waste heat. The matching of the temperature difference zone in the heat exchange process is better, the exergy destruction is smaller, and the heat exchange effect is better; in addition, utilizing repeated recovery of waste heat, the system is applicable to waste heat at a lower temperature and a wider range of organic working fluids. The system has lower environmental pollution and is more energy-saving and environment-friendly.

DESCRIPTION OF DRAWINGS

FIG. 1 shows an Organic Rankine cycle system with supercritical double-expansion and two-stage heat recovery.

In FIG. 1, the reference numbers represent the following: 1—first evaporator A; 2—first expander A; 3—first generator A; 4—second expander B; 5—second generator B; 6—steam mixer; 7—second evaporator B; 8—regenerator; 9—condenser; 10—second working pump B; 11—first working pump A.

EMBODIMENTS

In order to make the objects, technical scheme and advantages of the present invention more clearly, hereunder the present invention will be further described with reference to the drawings and embodiments. It should be understood that the embodiments described herein are only provided to explain the present invention, but shall not be intended to limit the present invention.

As shown in FIG. 1, the Organic Rankine cycle system with supercritical double-expansion and two-stage heat recovery provided in the present invention comprises a first-stage evaporation cycle system, a second-stage evaporation cycle system and a mixing system; wherein the outlet of a working pump A11 in the first-stage evaporation cycle system is connected to the inlet of an evaporator A1, the outlet of the evaporator A1 is connected to an expander A2, the expander A2 is connected to a generator A3, the outlet of the expander A2 is connected to the inlet of an evaporator B7, and the outlet of the evaporator B7 is connected to the inlet of a steam mixer 6.

The second-stage evaporation cycle system comprises a working pump B10, the outlet of the working pump B10 is connected to the inlet of a regenerator 8, the outlet of the regenerator 8 is connected to the inlet of the evaporator B7, the outlet of the evaporator B7 is connected to the expander B4, the expander B4 is connected to a generator B5, and the outlet of the expander B4 is connected to the inlet of the steam mixer 6.

The mixing system comprises the steam mixer 6, the outlet of the steam mixer 6 is connected to the exhaust inlet of the regenerator 8, the outlet of the regenerator 8 is connected to the inlet of a condenser 9, and the outlet of the condenser 9 is respectively connected to the working pump A11 and the working pump B10.

In order to better explain the scope protected by the present invention, hereinafter further description is made with respect to the working process of the present invention:

A part of the working fluid A is pressurized to the supercritical pressure by the working pump A11, and then is pumped into the inlet of the evaporator A1, and is heated up to a supercritical temperature in the evaporator A1, without transiting through a two-phase region. The high-temperature and high-pressure steam working fluid enters into the inlet of the expander A2, and is expanded in the expander A2 to do work, and the axial work of the expander A2 drives the generator A3 to rotate and generate electricity.

The other part of the working fluid B is pumped into the inlet of the regenerator 8 by the working pump B10, and exchanges heat with the steam from the steam mixer 6 in the regenerator 8. After the heat exchange, the working fluid B enters into the inlet of the evaporator B7, exchanges heat with the exhaust steam of the working fluid A from the expander A2 in the evaporator B7, and then enters into the expander B4. In the expander B4, the working fluid A expands and does work, and then drives the generator B5 to generate electricity.

The exhaust steam of the working fluid B from the expander B4 enters into the steam mixer 6 together with the exhaust steam of the working fluid A after the heat exchange. The exhaust steam from the steam mixer 6 exchanges heat in the regenerator 8 and then enters into the inlet of the condenser 9. In the condenser 9, the exhaust steam transfers heat to the cooling water and turns into a low-temperature and low-pressure liquid working fluid. The liquid working fluid flows out of the outlet of the condenser 9, and then is split into two parts: a working fluid A and a working fluid B, wherein the working fluid A enters into the working pump A, while the working fluid B enters into the working pump B. Then the next cycle is proceeded.

The cycle working fluid in the present invention can be pure working fluids of R115, R125, R143a or R218, or mixed working fluids of R404a or R507a. In this embodiment, a refrigerant R115 may be selected for the cycle working fluid, and the critical pressure and critical temperature of the working fluid are 3.1 MPa and 80° C. respectively. A supercritical state refers to a state in which the pressure exceeds a critical pressure and the temperature exceeds a critical temperature.

The above embodiment is only used to explain the design idea and features of the present invention, and the purpose there of is to enable the person skilled in the art to understand the technical content of the present invention and thereby to implement the present invention. The protection scope of the present invention is not limited to the above embodiments. Therefore, any equivalent variation or modification made on the basis of the principle and design idea disclosed in the present invention should be deemed as falling in the protection scope of the present invention.

The invention claimed is:

1. An Organic Rankine cycle system with supercritical double-expansion and two-stage heat recovery, comprising a first-stage evaporation cycle system, a second-stage evaporation cycle system and a mixing system, wherein;

the first-stage evaporation cycle system pressurizes a first part of a cycle working fluid by means of a first working pump, then the first part of the cycle working fluid is heated by means of a first evaporator, and then the first part of the cycle working fluid inputs to a first expander and generates electric energy;

an outlet of the first expander feeds the first part of the cycle working fluid to a high temperature side inlet of a second evaporator and a high temperature side outlet of the second evaporator then feeds the first part of the cycle working fluid to a first inlet of a steam mixer of the mixing system;

the second-stage evaporation cycle system feeds a second part of the cycle working fluid to a second working pump, a regenerator and to a low temperature side inlet of the second evaporator sequentially, a low temperature side outlet of the second evaporator then feeds the second part of the cycle working fluid to a second expander and generates electric energy;

an output of the second expander then feeds the second part of the cycle working fluid to a second inlet of the steam mixer of the mixing system to combine the first and second parts of the cycle working fluid obtain a total cycle working fluid, then the total cycle working fluid is cooled down and transferred to a next working cycle.

2. The Organic Rankine cycle system with supercritical double-expansion and two-stage heat recovery according to claim 1, wherein an outlet of the first working pump is connected to a low temperature side inlet of the first evaporator, a low temperature side outlet of the first evaporator is connected to the first expander and the first expander is connected to a first generator.

3. The Organic Rankine cycle system with supercritical double-expansion and two-stage heat recovery according to claim 1, wherein an outlet of the second working pump is connected to a low temperature side inlet of the regenerator, a low temperature side outlet of the regenerator is connected to a low temperature side inlet of the second evaporator, the low temperature side outlet of the second evaporator is connected to the second expander and the second expander is connected to a second generator.

4. The Organic Rankine cycle system with supercritical double-expansion and two-stage heat recovery according to claim 1, wherein the outlet of the steam mixer feeds the total cycle working fluid to a high temperature side inlet of the regenerator, a high temperature side outlet of the regenerator feeds the total cycle working fluid to an inlet of a condenser, and an outlet of the condenser is respectively connected to the first working pump and the second working pump.

5. The Organic Rankine cycle system with supercritical double-expansion and two-stage heat recovery according to claim 1, wherein the first working pump pressurizes the cycle working fluid to a supercritical pressure.

6. The Organic Rankine cycle system with supercritical double-expansion and two-stage heat recovery according to claim 1, wherein the first evaporator heats the cycle working fluid to a supercritical temperature.

7. The Organic Rankine cycle system with supercritical double-expansion and two-stage heat recovery according to claim 1, wherein the cycle working fluid can be pure working fluids of R115, R125, R143a or R218, or mixed working fluids of R404a or R507a.

8. An Organic Rankine cycle system with supercritical double-expansion and two-stage heat recovery, comprising:

a first working pump comprising an inlet and an outlet;

a first evaporator comprising a low temperature side inlet, a low temperature side outlet, a high temperature side inlet and a high temperature side outlet, wherein the low temperature side inlet of the first evaporator is connected to the first working pump outlet;

a first expander comprising an inlet and an outlet, wherein the first expander inlet is connected to the low temperature side outlet of the first evaporator;

a second working pump comprising an inlet and an outlet;

a regenerator comprising a low temperature side inlet, a low temperature side outlet, a high temperature side inlet and a high temperature side outlet, wherein the low temperature side inlet of the regenerator is connected to the second working pump outlet;

a second evaporator comprising a low temperature side inlet, a low temperature side outlet, a high temperature side inlet and a high temperature side outlet, wherein the low temperature side inlet of the second evaporator is connected to the low temperature side outlet of the regenerator and the high temperature side inlet of the second evaporator is connected to the first expander outlet;

a second expander comprising an inlet and an outlet, wherein the second expander inlet is connected to the low temperature side outlet of the second evaporator;

a steam mixer comprising a first inlet, a second inlet and an outlet, wherein the first inlet of the steam mixer is connected to the second expander outlet, the second inlet of the steam mixer is connected to the high temperature side outlet of the second expander, and the outlet of the steam mixer is connected to the high temperature side inlet of the regenerator;

a condenser comprising a low temperature side inlet, a low temperature side outlet, a high temperature side inlet and a high temperature side outlet, wherein the high temperature side inlet of the condenser is connected to the high temperature side outlet of the regenerator; and a split comprising an inlet, a first outlet and a second outlet, wherein the inlet of the split is connected to the high temperature side outlet of the condenser, the first outlet of the split is connected to the first working pump inlet, and the second outlet of the split is connected to the second working pump inlet;

wherein the first working pump is operable to pressurize a first part of a cycle working fluid to a supercritical first pressure prior to the first part of the cycle working fluid entering the low temperature side inlet of the first evaporator and the second working pump is operable to simultaneously pressurize a second part of the cycle working fluid to a second pressure prior to the second part of the cycle working fluid entering the low temperature side inlet of the regenerator, the second pressure being lower than the first pressure.

9. The Organic Rankine cycle system with supercritical double-expansion and two-stage heat recovery according to claim 8, wherein:

the first working pump operable to pressurize a first part of a cycle working fluid to the supercritical first pressure;

the first evaporator operable to receive the first part of the cycle working fluid from the outlet of the first working pump and to heat the first part of the cycle working fluid to a supercritical first temperature by means of a heat source flowing through the high temperature side inlet and outlet of the first evaporator;

the first expander operable to receive the first part of the cycle working fluid from the low temperature side outlet of the first evaporator, the first expander being operable to generate electric energy as the first part of the cycle working fluid is expanded to a subcritical third pressure and a subcritical second temperature by the first expander;

the second working pump operable to pressurize a second part of the cycle working fluid to the second pressure, the second pressure being a subcritical pressure;

the low temperature side input of the regenerator operable to receive the second part of the cycle working fluid from the outlet of the second working pump;

the low temperature side inlet of the second evaporator operable to receive the second part of the cycle working fluid from the low temperature side outlet of the regenerator;

the second expander operable to receive the second part of the cycle working fluid from the low temperature side outlet of the second evaporator, the second expander being operable to generate electric energy as the second part of the cycle working fluid is expanded through the second expander;

the high temperature side inlet of the second evaporator operable to receive the first part of the cycle working fluid from the first expander output, the second evaporator operable to heat the second part of the cycle working fluid to a third temperature that is less than the second temperature with heat from the first part of the cycle working fluid as both the first and second parts of the cycle working fluid flow through the second evaporator;

the first inlet of the steam mixer operable to receive the expanded second part of the cycle working fluid from the outlet of the second expander, the second inlet of the steam mixer operable to receive the first part of the cycle working fluid from the high temperature side outlet of the second evaporator, wherein the steam mixer is operable to combine the first and second parts of the cycle working fluids to obtain a total cycle working fluid;

the high temperature side inlet of the regenerator operable to receive the total cycle working fluid from the outlet the steam mixer, the regenerator operable to heat the second part of the cycle working fluid with heat from the total cycle working fluid to a fourth temperature that is less than the third temperature as both the first part of the cycle working fluid and the total cycle working fluid flow through the regenerator;

the high temperature side inlet of the condenser being operable to receive the total cycle working fluid from the high temperature side outlet of the regenerator, the condenser operable to cool the total cycle working fluid by means of a coolant flowing through the low temperature side inlet and outlet of the condenser; and the split operable to receive the total cycle working fluid from the high temperature side outlet of the condenser, wherein the split is operable to separate the total cycle working fluid into the first and second parts of the cycle working fluid, the first part of the cycle working fluid entering into the inlet of the first pump and the second part of the cycle working fluid entering into the inlet of the second pump to begin a next working cycle.

* * * * *